US009188937B2

(12) United States Patent
Tsujita

(10) Patent No.: US 9,188,937 B2
(45) Date of Patent: Nov. 17, 2015

(54) IMAGE FORMING APPARATUS HAVING A PHOTORECEPTOR REFRESH UNIT TO DETECT A DETERIORATED PHOTORECEPTOR DRUM AND PERFORM A PHOTORECEPTOR-REFRESH CONTROL PROCESS

(71) Applicant: KYOCERA Document Solutions Inc., Osaka (JP)

(72) Inventor: Mitsuji Tsujita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/464,446

(22) Filed: Aug. 20, 2014

(65) Prior Publication Data

US 2015/0063837 A1 Mar. 5, 2015

(30) Foreign Application Priority Data

Aug. 30, 2013 (JP) ..... 2013-179582

(51) Int. Cl.
*G03G 15/00* (2006.01)
*G03G 21/00* (2006.01)

(52) U.S. Cl.
CPC ..... *G03G 21/0005* (2013.01)

(58) Field of Classification Search
CPC ..... G03G 21/0005
USPC ..... 399/26, 27, 29, 34
See application file for complete search history.

(56) References Cited

U.S. PATENT DOCUMENTS

| | | | | | |
|---|---|---|---|---|---|
| 5,162,849 | A * | 11/1992 | Yoshino et al. | 399/29 |
| 5,592,270 | A * | 1/1997 | Takai et al. | 399/260 |
| 5,750,308 | A * | 5/1998 | Tsujita et al. | 430/123.4 |
| 5,915,156 | A * | 6/1999 | Kizaki et al. | 399/346 |
| 7,013,093 | B2 * | 3/2006 | Nakazato | 399/27 |
| 7,095,966 | B2 * | 8/2006 | Adachi | 399/27 |
| 7,269,382 | B2 * | 9/2007 | Hashimoto | 399/284 |
| 7,272,331 | B2 * | 9/2007 | Kobayashi et al. | 399/44 |
| 7,756,436 | B2 * | 7/2010 | Yamane | 399/71 |
| 8,090,277 | B2 * | 1/2012 | Hitaka | 399/29 |
| 8,320,785 | B2 * | 11/2012 | Ishida | 399/71 |
| 2003/0228159 | A1 * | 12/2003 | Tungate et al. | 399/27 |
| 2004/0151514 | A1 * | 8/2004 | Shuji | 399/29 |

(Continued)

FOREIGN PATENT DOCUMENTS

| | | | |
|---|---|---|---|
| JP | 2005-266544 | A | 9/2005 |
| JP | 2006139111 | A * | 6/2006 |

(Continued)

*Primary Examiner* — David Bolduc
(74) *Attorney, Agent, or Firm* — Stein IP, LLC

(57) ABSTRACT

An image forming apparatus includes a plurality of photoreceptor drums, a plurality of developing devices, a plurality of polishing members, an endless intermediate transfer component, a primary transfer unit, a secondary transfer unit, a secondary transfer unit, a development refresh unit, and a photoreceptor refresh unit. The photoreceptor refresh unit is configured such that, in executing the photoreceptor-refresh control process, if the development refresh unit detects a toner-deteriorated developing device, the circumferential surface of the deteriorated photoreceptor drum is polished, by the polishing member provided for the deteriorated photoreceptor drum, using the polishing-agent contained in the toner discharged from the toner-deteriorated developing device by the development refresh unit executing the development-refresh control process.

2 Claims, 6 Drawing Sheets

(56) References Cited

U.S. PATENT DOCUMENTS

| | | | | |
|---|---|---|---|---|
| 2005/0084305 | A1* | 4/2005 | Nishida et al. | 399/346 |
| 2006/0008281 | A1* | 1/2006 | Matsumoto et al. | 399/27 |
| 2006/0228125 | A1* | 10/2006 | Itagaki et al. | 399/55 |
| 2007/0071506 | A1* | 3/2007 | Uetake et al. | 399/272 |
| 2007/0104499 | A1* | 5/2007 | Ariizumi et al. | 399/27 |
| 2007/0212082 | A1* | 9/2007 | Hisakuni | 399/38 |
| 2007/0212122 | A1* | 9/2007 | Maeyama et al. | 399/267 |
| 2007/0223948 | A1* | 9/2007 | Matsui | 399/27 |
| 2008/0056786 | A1* | 3/2008 | Ishino et al. | 399/357 |
| 2008/0069618 | A1* | 3/2008 | Ishino et al. | 399/360 |
| 2008/0152366 | A1* | 6/2008 | Endou et al. | 399/27 |
| 2008/0212988 | A1* | 9/2008 | Hirota | 399/53 |
| 2009/0003865 | A1* | 1/2009 | Endou et al. | 399/66 |
| 2009/0060534 | A1* | 3/2009 | Murauchi et al. | 399/30 |
| 2009/0110414 | A1* | 4/2009 | Itoyama et al. | 399/27 |
| 2009/0214233 | A1* | 8/2009 | Murauchi et al. | 399/30 |
| 2009/0290885 | A1* | 11/2009 | Maruyama | 399/27 |
| 2009/0290886 | A1* | 11/2009 | Murauchi et al. | 399/27 |
| 2009/0290887 | A1* | 11/2009 | Murauchi et al. | 399/27 |
| 2009/0297176 | A1* | 12/2009 | Haruyama | 399/27 |
| 2010/0054818 | A1* | 3/2010 | Izumi et al. | 399/262 |
| 2010/0104300 | A1* | 4/2010 | Shinohara | 399/43 |
| 2010/0272455 | A1* | 10/2010 | Muramoto et al. | 399/43 |
| 2011/0052220 | A1* | 3/2011 | Nose | 399/27 |
| 2011/0052221 | A1* | 3/2011 | Hirobe et al. | 399/27 |
| 2011/0255885 | A1* | 10/2011 | Yugeta et al. | 399/27 |
| 2011/0274452 | A1* | 11/2011 | Fukuyama et al. | 399/43 |
| 2011/0318023 | A1* | 12/2011 | Thayer et al. | 399/27 |
| 2013/0034365 | A1* | 2/2013 | Nakade | 399/72 |
| 2013/0051822 | A1* | 2/2013 | Nose | 399/29 |

FOREIGN PATENT DOCUMENTS

| | | | |
|---|---|---|---|
| JP | 2007199545 | A * | 8/2007 |
| JP | 2010-72168 | A | 4/2010 |
| JP | 2010224132 | A * | 10/2010 |
| JP | 2010276705 | A * | 12/2010 |
| JP | 2012177721 | A * | 9/2012 |

* cited by examiner

IMAGE FORMING APPARATUS HAVING A PHOTORECEPTOR REFRESH UNIT TO DETECT A DETERIORATED PHOTORECEPTOR DRUM AND PERFORM A PHOTORECEPTOR-REFRESH CONTROL PROCESS

CROSS-REFERENCE TO RELATED APPLICATION

This application is based upon, and claims the benefit of priority from, corresponding Japanese Patent Application No. 2013-179582, filed in the Japan Patent Office on Aug. 30, 2013, the entire contents of which are incorporated herein by reference.

BACKGROUND OF THE INVENTION

Unless otherwise indicated herein, the description in this section is not prior art to the claims in this application and is not admitted to be prior art by inclusion in this section.

There is known a full-color image forming apparatus of a tandem engine with a plurality of photoreceptor drums. A plurality of the photoreceptor drums are arranged along an intermediate transfer belt. Each photoreceptor drum is provided with a charger, a developing apparatus, a transfer apparatus, a cleaning apparatus with a rubbing roller, and a similar apparatus at a peripheral area. The charger causes a circumference surface of the photoreceptor drum to be charged by a discharge operation. Irradiating light from an exposure apparatus forms an electrostatic latent image at the circumference surface of the photoreceptor drum charged by the charger. The developing apparatus develops the electrostatic latent image formed at the circumference surface of the photoreceptor drum as a toner image. The transfer apparatus transfers the toner on the developed photoreceptor drum to a target transfer member. A blade or a similar tool of the cleaning apparatus scrapes off toner remaining on the photoreceptor drum that has not been transferred. By rotation of the rubbing roller in contact with the circumference surface of the photoreceptor drum, the toner that has not been transferred polishes the circumference surfaces of the respective photoreceptor drums. Thus, the rubbing roller shaves off a foreign object such as corona products adhered to the circumference surface of the photoreceptor drum.

The developing apparatus supplies (transfers) toner to the circumference surface of the photoreceptor drum requiring polishing by the rubbing roller among the plurality of photoreceptor drums. The toner contains a polishing-agent. Interaction of the polishing-agent and the rubbing roller polishes the circumference surface of the photoreceptor drum. The developing apparatus arranged at the peripheral area of the photoreceptor drum usually supplies toner to the circumference surface of the photoreceptor drum. Besides, for example, the developing apparatus located at an uppermost stream in a conveyance direction of an intermediate transfer belt among a plurality of developing apparatuses may supply toner to the photoreceptor drum requiring polishing. In this case, the intermediate transfer belt is used as a toner supply unit.

The image forming apparatus of tandem engine includes respective developing apparatuses accumulating toners with respective different colors. Among them, since the developing apparatus accumulates a toner with color of low usage frequency (printing rate) over a long period of time, deterioration of such toner proceeds faster than other toners by stirring in the developing apparatus or a similar operation.

The deteriorated toner will be one cause of image quality deterioration of a printed image. Accordingly, a typical image forming apparatus performs a development refresh control to forcibly discharge deteriorated toner in the developing apparatus when an image is not formed.

SUMMARY OF THE INVENTION

An image forming apparatus according to the disclosure includes a plurality of photoreceptor drums, a plurality of developing devices, a plurality of polishing members, an endless intermediate transfer component, a primary transfer unit, a secondary transfer unit, a secondary transfer unit, a development refresh unit, and a photoreceptor refresh unit. The plurality of photoreceptor drums each have a circumferential surface for a formation of an electrostatic latent image. The plurality of developing devices are provided for each of the plurality of photoreceptor drums. The plurality of developing devices are configured to cause polishing-agent containing toner to adhere to the circumferential surfaces of the photoreceptor drums to form toner images corresponding to the electrostatic latent images. The plurality of polishing members are provided for each of the plurality of photoreceptor drums. The plurality of polishing members are configured to polish the circumferential surfaces of the photoreceptor drums using the polishing-agent contained in the toner. On the endless intermediate transfer component, the toner images on the circumferential surfaces of the photoreceptor drums are transferred. The primary transfer unit is configured to the transfer toner images on the circumferential surfaces of the photoreceptor drums onto the intermediate transfer component. The secondary transfer unit is configured to transfer onto a recording medium the toner images transferred onto the intermediate transfer component. The development refresh unit is configured to detect, among the plurality of developing devices, a toner-deteriorated developing device in which deteriorated toner exceeds a predetermined proportion, and is configured to perform a development-refresh control process whereby toner from the detected toner-deteriorated developing device is discharged and the discharged toner is passed onto the circumferential surface of the photoreceptor drum corresponding to the toner-deteriorated developing device. The photoreceptor refresh unit is configured to detect, among the plurality of photoreceptor drums, a deteriorated photoreceptor drum requiring polishing by the polishing member, and is configured to perform a photoreceptor-refresh control process whereby the circumferential surface of the detected deteriorated photoreceptor drum is polished by the polishing member provided for the deteriorated photoreceptor drum. The photoreceptor refresh unit is configured such that, in executing the photoreceptor-refresh control process, if the development refresh unit detects a toner-deteriorated developing device, the circumferential surface of the deteriorated photoreceptor drum is polished, by the polishing member provided for the deteriorated photoreceptor drum, using the polishing-agent contained in the toner discharged from the toner-deteriorated developing device by the development refresh unit executing the development-refresh control process.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
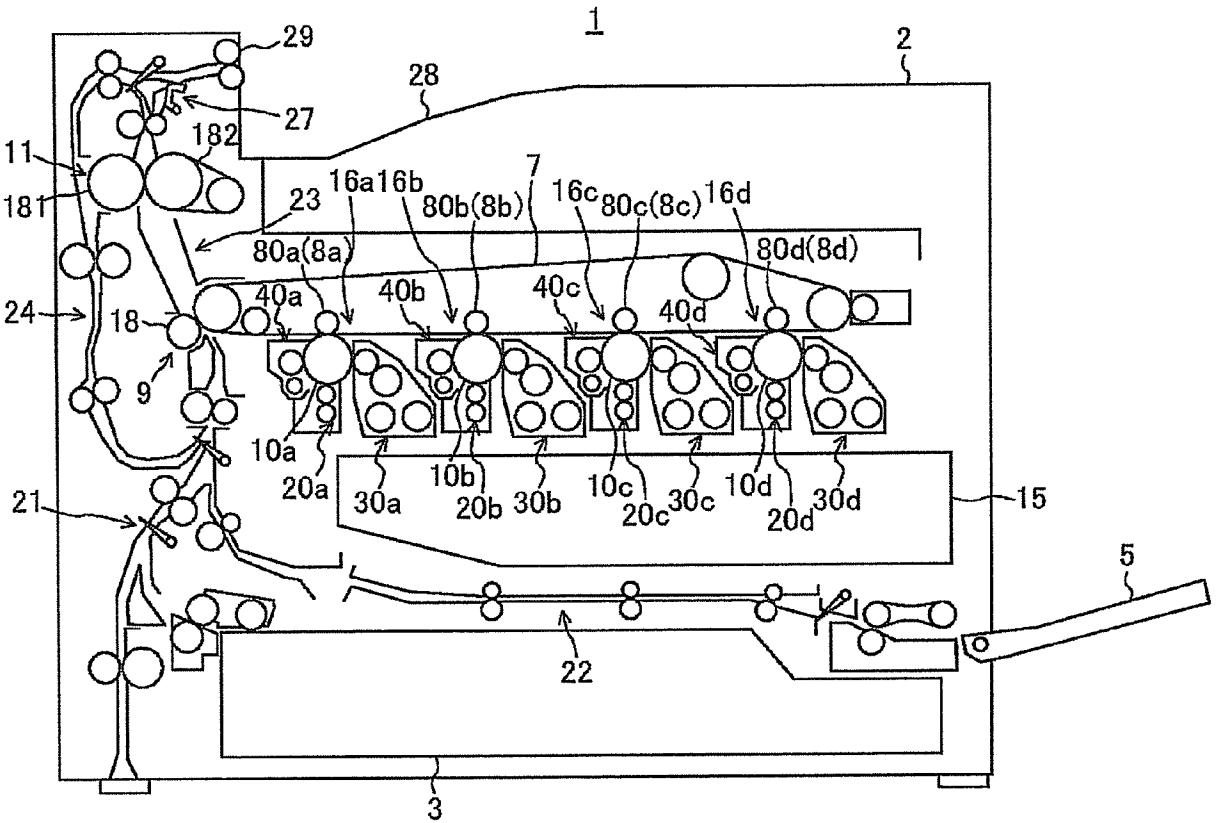
FIG. 1 illustrates a cross section of a schematic configuration of an image forming apparatus according to a first embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

First Embodiment

The following describes the first embodiment of the disclosure in detail based on the accompanying drawings. The disclosure should not be limited to the following embodiments.

Overall Configuration

FIG. 1 illustrates an image forming apparatus 1 according to a first embodiment. This image forming apparatus 1 is a color printer of a tandem engine. The image forming apparatus 1 includes an intermediate transfer belt 7, primary transfer units 8*a* to 8*d*, a secondary transfer unit 9, a fixing unit 11, a light scanning device 15, four image forming units 16*a* to 16*d*, and first to fourth paper sheet conveyors 21 to 24.

The image forming apparatus 1 includes a sheet feed cassette 3 at a lower portion inside of a main body 2. The sheet feed cassette 3 internally loads and houses paper sheets (not illustrated) such as a cut paper before printing. This paper sheets are separated one by one and sent out to a left upper side of the sheet feed cassette 3 in FIG. 1.

The first paper sheet conveyor 21 is located at a side of the sheet feed cassette 3. The first paper sheet conveyor 21 is arranged along a left side surface of the main body 2. The first paper sheet conveyor 21 receives the paper sheet sent out from the sheet feed cassette 3, and then conveys the paper sheet to the secondary transfer unit 9, which is located upward, along the left side surface of the main body 2.

A manual paper feed tray 5 is located at a right side of the sheet feed cassette 3. At the manual paper feed tray 5, a paper sheet with a size that cannot be housed in the sheet feed cassette 3, a cardboard, an OHP sheet, or a similar sheet is placed. At the left side of the manual paper feed tray 5, the second paper sheet conveyor 22 is located. The second paper sheet conveyor 22 approximately horizontally extends from the manual paper feed tray 5 to the first paper sheet conveyor 21, and then connects to the first paper sheet conveyor 21. The second paper sheet conveyor 22 receives the paper sheet or a similar sheet sent out from the manual paper feed tray 5 and conveys the paper sheet or a similar sheet to the first paper sheet conveyor 21.

The light scanning device 15 is arranged above the second paper sheet conveyor 22. Here, the image forming apparatus 1 receives image data transmitted from the outside. A temporary storage unit 65 (see FIG. 3) stores this image data, and then the image data is transmitted to the light scanning device 15 as necessary. The light scanning device 15 irradiates laser beam controlled based on the image data to the photoreceptor drums 10*a* to 10*d* of the image forming units 16*a* to 16*d*.

The image forming units 16*a* to 16*d* are located at an upper side of the light scanning device 15. The image forming units 16*a* to 16*d* include photoreceptor drums 10*a* to 10*d*, respectively. The photoreceptor drums 10*a* to 10*d* include chargers 20*a* to 20*d*, developing apparatuses 30*a* to 30*d*, and cleaning apparatuses 40*a* to 40*d*, respectively. The cleaning apparatuses 40*a* to 40*d* are located to clean the circumference surfaces of the photoreceptor drums 10*a* to 10*d*, respectively.

The endless intermediate transfer belt 7 is located at the upper side of the respective image forming units 16*a* to 16*d*. The intermediate transfer belt 7 is wound and hung around a plurality of rollers and is rotatably driven by a driving device (not illustrated).

The four image forming units 16*a* to 16*d* are arranged in a row along the intermediate transfer belt 7 as illustrated in FIG. 1. The image forming units 16*a* to 16*d* form toner images of yellow, magenta, cyan, or black, respectively. That is, the respective image forming units 16*a* to 16*d* form electrostatic latent images of document images with the laser beam irradiated by the light scanning device 15. Developing the electrostatic latent images forms the toner images with respective colors. The details of the image forming units 16*a* to 16*d* will be described later.

The primary transfer units 8*a* to 8*d* are arranged at the upper side of the respective image forming units 16*a* to 16*d*. The primary transfer units 8*a* to 8*d* include primary transfer rollers 80*a* to 80*d*, respectively. The primary transfer rollers 80*a* to 80*d* primarily transfer the toner images formed by the image forming units 16*a* to 16*d* to the surface of the intermediate transfer belt 7. A transfer bias power source 603 applies a transfer bias to the primary transfer rollers 80*a* to 80*d*. The transfer bias applied to the primary transfer rollers 80*a* to 80*d* transfers the toner images of the respective image forming units 16*a* to 16*d* to the intermediate transfer belt 7 at a predetermined timing. Thus, color toner images where the toner images with four colors, yellow, magenta, cyan, and black are superimposed are formed on the surface of the intermediate transfer belt 7.

The secondary transfer unit 9 includes a secondary transfer roller 18 arranged at the left side of the intermediate transfer belt 7. The transfer bias power source 603 applies the transfer bias to the secondary transfer roller 18. The secondary transfer roller 18 sandwiches a paper sheet P with the intermediate transfer belt 7. Thus, the transfer bias applied to the secondary transfer roller 18 transfers the toner image on the intermediate transfer belt 7 to the paper sheet P.

The fixing unit 11 is located at the upper side of the secondary transfer unit 9. The third paper sheet conveyor 23 is formed between the secondary transfer unit 9 and the fixing unit 11. The third paper sheet conveyor 23 conveys the paper sheet P on which the toner image is secondarily transferred to the fixing unit 11.

The fixing unit 11 includes a heating roller 182 and a pressure roller 181 that each rotate. Then, the fixing unit 11 sandwiches the paper sheet P with the heating roller 182 and the pressure roller 181 to heat and pressurize the toner image transferred on the paper sheet P so as to fix the toner image on the paper sheet P.

A branch unit 27 is located at the upper side of the fixing unit 11. When duplex printing is not performed, the paper sheet P discharged from the fixing unit 11 is discharged from the branch unit 27 to a paper sheet discharge unit 28 formed at the top of the image forming apparatus 1.

A discharge port part from which the paper sheet P is discharged from the branch unit 27 to the paper sheet discharge unit 28 functions as a switchback portion 29. For duplex printing, the conveyance direction of the paper sheet P discharged from the fixing unit 11 is switched at the switchback portion 29.

Image Forming Unit

Figure 2:
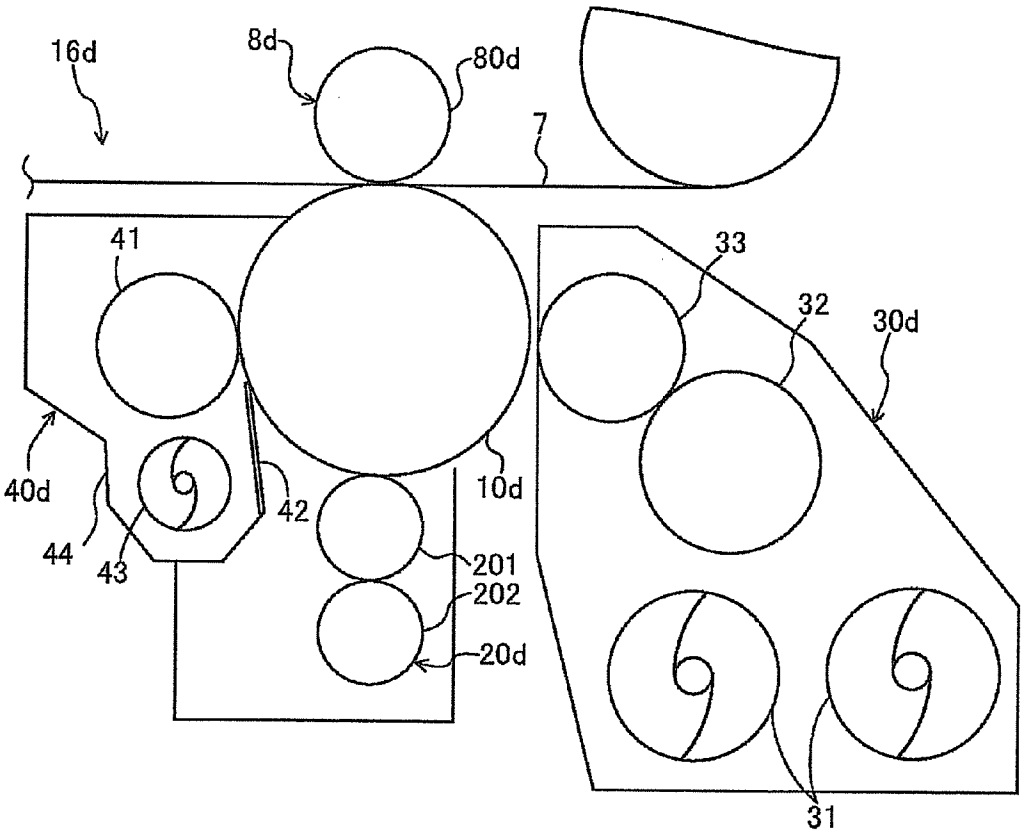
FIG. 2 illustrates an enlarged image forming unit and a cleaning apparatus at a side of the image forming unit according to the first embodiment.

FIG. 2 illustrates an enlarged portion near the image forming unit 16*d*. The configurations of the respective image forming units 16*a* to 16*d* are basically similar, and therefore the descriptions of the other three image forming units 16*a* to 16*c* will not be further elaborated here. The image forming unit 16*d* includes the photoreceptor drum 10*d*, the charger 20*d*, the developing apparatus 30*d*, and the cleaning apparatus 40*d*.

The photoreceptor drum 10*d* has a cylindrical shape. A photosensitive layer made of an a-Si material is formed across the whole outer circumference surface of the photoreceptor drum 10*d*. A shaft member (not illustrated) that passes through its shaft center portion rotatably supports the photoreceptor drum 10*d*.

The charger 20*d* is arranged at the lower side of the photoreceptor drum 10*d*. The charger 20*d* includes a charging roller 201 and a charge cleaning roller 202. The charging roller 201 is slidably in contact with the photoreceptor drum 10*d* and applies a charging bias to the circumference surface of the photoreceptor drum 10*d*. The charge cleaning roller 202 cleans the charging roller 201. The charging roller 201 is connected to a charging bias power source 602 (see FIG. 3). The charger 20*d* applies the charging bias to the photoreceptor drum 10*d* via the charging roller 201, thus the circumference surface of the photoreceptor drum 10*d* is charged to a predetermined electric potential. With this state, the light scanning device 15 irradiates the laser beam on the circumference surface of the photoreceptor drum 10*d*, thus the electrostatic latent image is formed.

The developing apparatus 30*d* is arranged at the lateral side of the photoreceptor drum 10*d*. The developing apparatus 30*d* includes two toner conveyance screws 31, a magnetic roller 32, and a developing roller 33. The developing roller 33 is connected to a developing bias power source 601 (see FIG. 3). The developing apparatus 30*d* forms a thin toner layer at the developing roller 33 using a magnetic brush that stands at the surface of the magnetic roller 32. Additionally, the developing apparatus 30*d* applies a developing bias with the same polarity (positive) as the polarity of the toner to the developing roller 33 so as to transfer the toner to the circumference surface of the drum. When this transferred toner adheres to the electrostatic latent image formed at the circumference surface of the photoreceptor drum 10*d*, the electrostatic latent image is developed and the toner image is formed at the drum circumference surface.

Cleaning Apparatus

The following describes the cleaning apparatus 40*d* with reference to FIG. 2. The configurations of the respective cleaning apparatuses 40*a* to 40*d* are basically similar, and therefore the descriptions of the other three cleaning apparatuses 40*a* to 40*c* will not be further elaborated here.

The cleaning apparatus 40*d* is arranged at a side opposite to the developing apparatus 30*d* side of the photoreceptor drum 10*d*. The cleaning apparatus 40*d* includes a rubbing roller 41, a cleaning blade 42, a recovery screw 43, and a cleaning case 44.

The rubbing roller 41 is brought into pressure contact with the photoreceptor drum 10*d* at a predetermined pressure. A driving unit (not illustrated) rotates the rubbing roller 41 in the same direction as the photoreceptor drum 10*d* at the portion contacting the photoreceptor drum 10*d*. Thus, using the polishing-agent contained in the toner, the rubbing roller 41 functions as a polishing member to polish the circumference surface of the photoreceptor drum 10*d*.

The cleaning blade 42 is in abutting contact with the circumference surface of the photoreceptor drum 10*d* at the downstream in a rotation direction with respect to the portion at which the rubbing roller 41 is in contact with the circumference surface of the photoreceptor drum 10*d*. The cleaning blade 42 scrapes off the toner adhered to the circumference surface of the photoreceptor drum 10*d* so as to drop the toner in the cleaning case 44. The remaining toner removed from the circumference surface of the photoreceptor drum 10*d* by the cleaning blade 42 is discharged to the outside of the cleaning apparatus 40*d* in association with the rotation of the recovery screw 43. A neutralization lamp (not illustrated) is arranged between the cleaning apparatus 40*d* and the charger 20*d*. The neutralization lamp irradiates light on the circumference surface of the photoreceptor drum 10*d* to remove a residual charge on the circumference surface of the photoreceptor drum 10*d*.

Configuration of Control System

Figure 3:
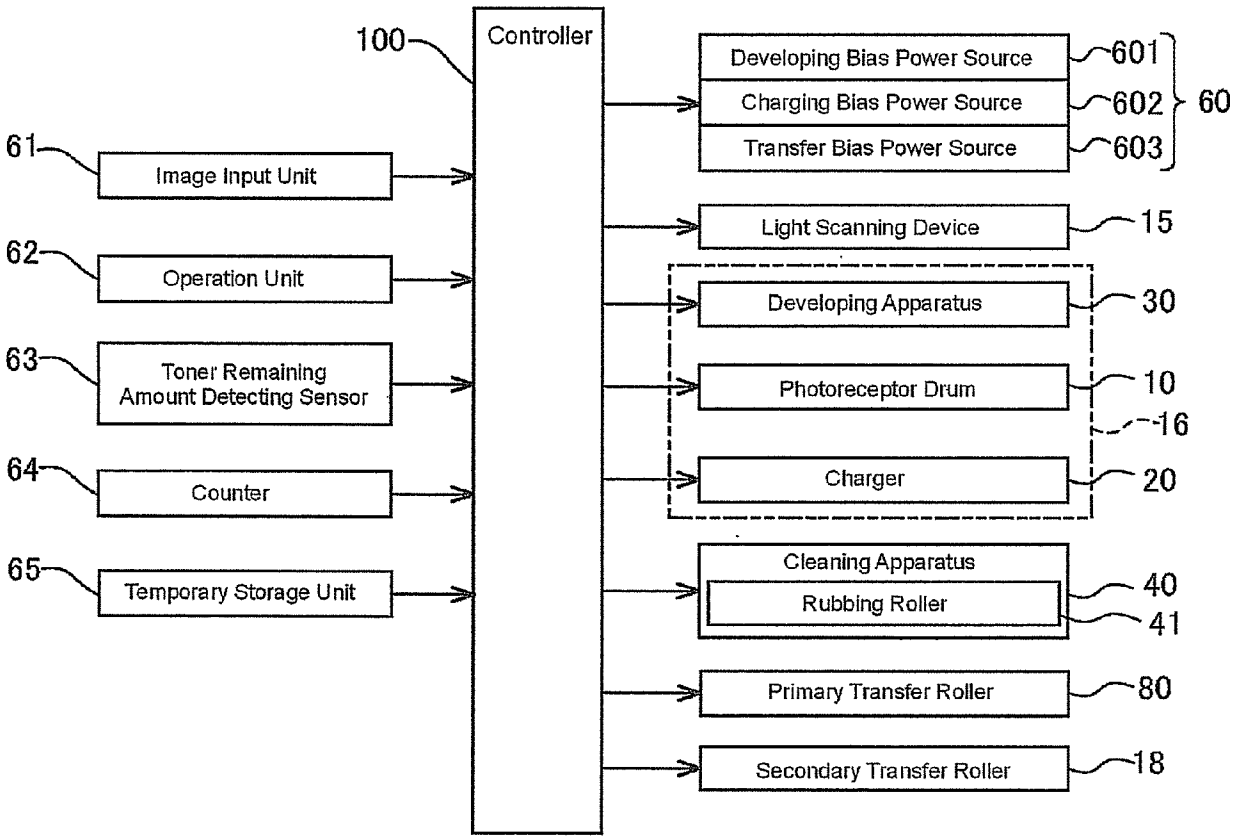
FIG. 3 illustrates a configuration of a control system according to the first embodiment.

The following describes a configuration of a control system of the image forming apparatus 1 with reference to FIG. 3. The image forming apparatus 1 includes a controller 100 for controlling the entire operation of the image forming apparatus 1. The controller 100 is constituted of a microcomputer that includes a CPU, a RAM, a ROM, or a similar component. The controller 100 controls devices and control components inside of the image forming apparatus 1 based on input signals input from an image input unit 61, an operation unit 62, a toner remaining amount detecting sensor 63, a counter 64, the temporary storage unit 65, or a similar unit. The devices and the control components include the above-described light scanning device 15, developing apparatuses 30*a* to 30*d*, photoreceptor drums 10*a* to 10*d*, chargers 20*a* to 20*d*, cleaning apparatuses 40*a* to 40*d*, primary transfer rollers 80*a* to 80*d*, and secondary transfer roller 18, a bias power source 60, or a similar device or a component. The bias power source 60 includes the developing bias power source 601, the charging bias power source 602, and the transfer bias power source 603.

The image input unit 61 receives image data transmitted from an external terminal such as a personal computer and outputs the image data to the controller 100.

The operation unit 62 includes, for example, a touch panel liquid crystal display and a numeric keypad. The operation of the operation unit 62 by a user ensures various settings such as the number of printed sheets and execution of a print start instruction. The operation unit 62 outputs an operation by the user as an operation signal to the controller 100.

The toner remaining amount detecting sensor 63 detects a toner remaining amount in the respective developing apparatuses 30*a* to 30*d*. The counter 64 integrates and counts the number of printed sheets. The counter 64 needs not to be separately located but, for example, the RAM may store the number of printed sheets. The temporary storage unit 65 temporarily stores the image data or similar data.

The controller 100 runs a control program stored in a ROM (not illustrated) to perform an image forming control, a photoreceptor refresh control, and a development refresh control. Among the three controls, the photoreceptor refresh control and the development refresh control are performed while the image forming control is not performed (while an image is not formed).

The image forming control conveys the paper sheet using the paper sheet conveyors 21 to 24 and prints the image on the paper sheet by the image forming units 16*a* to 16*d*, the primary transfer units 8*a* to 8*d*, the secondary transfer unit 9, and the fixing unit 11, which are located on the conveying path.

The development refresh control is a control to forcibly discharge deteriorated toner in the developing apparatuses 30*a* to 30*d*. The development refresh control first detects toner-deteriorated developing apparatus where a proportion of the deteriorated toner is equal to or more than a predetermined proportion among the four developing apparatuses 30*a* to 30*d*. Here, the toner is deteriorated due to, for example, stress acting on the toner by the toner conveyance screw 31. Accordingly, for example, if images are continuously formed at a low printing rate, despite that a consumption quantity of the toner is little, the stress acts on the toner from the toner conveyance screw 31. As a result, the proportion of the deteriorated toner increases. Therefore, this embodiment detects a developing apparatus provided with the image forming unit with an average printing rate of, for example, 1% or less as the toner-deteriorated developing apparatus. Then, the development refresh control applies the developing bias with the same polarity (positive) as the polarity of the toner to the developing roller 33 of the detected toner-deteriorated developing apparatus, so as to discharge the toner in the toner-deteriorated developing apparatus to the circumference surface of the photoreceptor drum corresponding to each developing apparatus.

In calculation of the average printing rate, first, based on the image data in the temporary storage unit 65, the printing rate of every image (proportion of a dot relative to the total pixels) bn is calculated. Next, the printing rate bn is integrated to calculate an integrated printing rate Σbn. Then, the integrated printing rate Σbn is divided into the number of printed sheets A counted by the counter 64, thus an average printing rate Σbn/A (%) is calculated.

The photoreceptor refresh control is a control for removing a foreign object such as corona products adhered to the circumference surfaces of the photoreceptor drums 10*a* to 10*d*. These corona products are an ion-yielding material such as NOx and Sox generated by decomposition of a constituent in the air by an ozone generated during discharge by the chargers 20*a* to 20*d*. Since this ion-yielding material is a water-soluble, when the ion-yielding material adheres to the circumference surfaces of the photoreceptor drums 10*a* to 10*d*, the ion-yielding material takes in water vapor in the atmosphere and reduces the surface resistance. Consequently, the electric potential at an edge portion of the electrostatic latent image formed at the circumference surfaces of the photoreceptor drums 10*a* to 10*d* flows transversely, causing a problem of a deterioration of image quality of printed images. To prevent this problem, the photoreceptor refresh control polishes the circumference surfaces of the photoreceptor drums 10*a* to 10*d* with the rubbing roller 41 using the polishing-agent contained in the toner discharged from the developing apparatuses 30*a* to 30*d*, thus shaving off the corona products adhered to the circumference surfaces.

Figure 4:
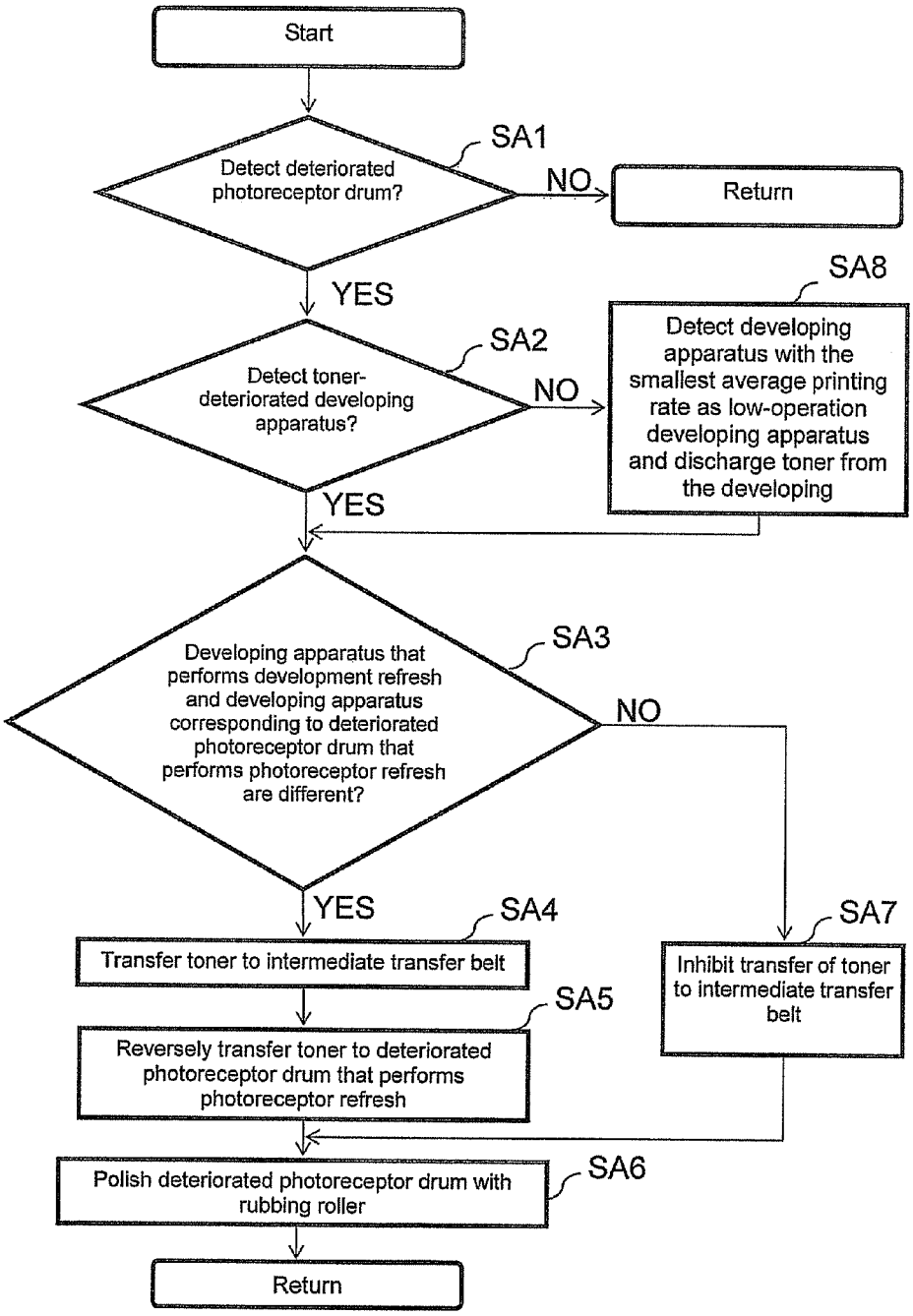
FIG. 4 illustrates a procedure of a photoreceptor refresh control by a controller according to the first embodiment.

The following specifically describes the photoreceptor refresh control by the controller 100 with reference to FIG. 4.

Step SA1 determines whether a deteriorated photoreceptor drum requiring polishing by the rubbing roller 41 among the four photoreceptor drums 10*a* to 10*d* is detected or not. Specifically, based on signals from driving motors of the photoreceptor drums 10*a* to 10*d*, the number of usages of the respective photoreceptor drums 10*a* to 10*d* from the execution of the previous drum refresh control up to the present is calculated. A photoreceptor drum whose number of usages exceeds this threshold is detected as a deteriorated photoreceptor drum. When the deteriorated photoreceptor drum is not detected (when the determination at this Step SA1 is NO), the process returns. On the other hand, when the deteriorated photoreceptor drum is detected (when the determination at this Step SA1 is YES), the process proceeds to Step SA2.

Step SA2 determines whether the toner-deteriorated developing apparatus is detected or not. When this determination is NO, the process proceeds to Step SA8. On the other hand, when this determination is YES, the process proceeds to Step SA3. The toner-deteriorated developing apparatuses 30*a* to 30*d* is simply detected based on the average printing rates of the respective image forming units 16*a* to 16*d* as described above.

Step SA3 determines whether the toner-deteriorated developing apparatus that performs the development refresh and the developing apparatus corresponding to the deteriorated photoreceptor drum are different or not. When this determination is NO, the process proceeds to Step SA7. On the other hand, when this determination is YES, the process proceeds to Step SA4.

Step SA4 is the case where the toner-deteriorated developing apparatus, which performs the development refresh, differs from the developing apparatus corresponding to the deteriorated photoreceptor drum. At Step SA4, execution of the development refresh control discharges the toner from the toner-deteriorated developing apparatus to cause the toner to adhere to the circumference surface of the photoreceptor drum corresponding to the developing apparatus. Then, the transfer bias with the same polarity as the polarity during the image formation is applied to the primary transfer roller, which is at the upper side of the image forming unit at which the toner-deteriorated developing apparatus is located. Thus, the deteriorated toner at the circumference surface of the photoreceptor drum is transferred to the intermediate transfer belt 7.

At Step SA5, when the deteriorated toner on the intermediate transfer belt 7 reaches the circumference surface of the deteriorated photoreceptor drum, the transfer bias with the reversed polarity to the polarity during the image formation is applied to the primary transfer roller, which is at the upper side of the image forming unit at which the deteriorated photoreceptor drum is located. Thus, the deteriorated toner on the intermediate transfer belt 7 is transitioned to the circumference surface of the deteriorated photoreceptor drum.

At Step SA6, driving the rubbing roller 41 of the cleaning apparatus located corresponding to the deteriorated photoreceptor drum polishes the circumference surface of the deteriorated photoreceptor drum and returns to the process after a lapse of certain time.

At Step SA7, to which the process proceeds when the determination at Step SA3 is NO, transfer of the toner from the photoreceptor drums 10*a* to 10*d* to the intermediate transfer belt 7 is inhibited. Specifically, for example, the transfer bias is not to be applied to the primary transfer rollers 80*a* to 80*d* or a transfer bias with a reversed polarity to the polarity during the image formation is applied to the primary transfer rollers 80*a* to 80*d*. Thus, after inhibiting the transfer of the toner to the intermediate transfer belt 7, the process proceeds to Step SA6.

At Step SA8, to which the process proceeds when the determination at Step SA2 is NO, as a value related to toner consumption rates (amounts of toner consumption in a constant period) of the respective developing apparatuses 30*a* to 30*d*, the average printing rates of the respective image forming units 16*a* to 16*d* are calculated (detected). The developing apparatus 30*a* to 30*d* located at the image forming unit 16*a* to 16*d* with the smallest average printing rate is detected as the low-operation developing apparatus 30*a* to 30*d* with the least toner consumption rate. The toner is discharged from the low-operation developing apparatuses 30*a* to 30*d*, and the process proceeds to Step SA3 after the elapse of certain time.

As described above, according to the first embodiment, when the toner-deteriorated developing apparatus is detected in the execution of the photoreceptor refresh control (when the determination at Step SA2 is YES), the controller 100 causes the toner to be discharged from the toner-deteriorated developing apparatus by execution of the development refresh control. Using the polishing-agent contained in the toner, the circumference surface of the deteriorated photoreceptor drum is polished with the rubbing roller 41 of the cleaning apparatus located corresponding to the deteriorated photoreceptor drum.

With this configuration, the execution of the development refresh control ensures polishing the deteriorated photoreceptor drum using the toner discharged from the toner-deteriorated developing apparatus. Here, a proportion of the deteriorated toner of the toner discharged from the toner-deteriorated developing apparatus exceeds a predetermined proportion. Accordingly, using the toner thus containing much deteriorated toner for polishing the deteriorated photoreceptor drum ensures reducing wasteful consumption of excellent toner.

With the first embodiment, when the controller 100 does not detect the toner-deteriorated developing apparatus in the execution of the photoreceptor refresh control (when the determination at Step SA2 is NO), the controller 100 calculates (detects) the average printing rates of the respective image forming units 16*a* to 16*d* as values related to the toner consumption rates of the respective developing apparatuses 30*a* to 30*d*. Additionally, the controller 100 detects the developing apparatus located at the image forming unit with the smallest calculated average printing rate as the low-operation developing apparatus with the smallest toner consumption rate, and causes the toner to be discharged from the low-operation developing apparatus (Step SA8). Using the polishing-agent contained in the toner discharged from the low-operation developing apparatus, the controller 100 causes the circumference surface of the deteriorated photoreceptor drum to be polished with the rubbing roller 41 of the cleaning apparatus located corresponding to the deteriorated photoreceptor drum.

When polishing the deteriorated photoreceptor drum, this configuration ensures reducing wasteful consumption of toner in the developing apparatus of high toner consumption rate (that is, the highly frequently used toner). Furthermore, a frequency of exchanging toner can be reduced.

Further, with the first embodiment, when the developing apparatus located corresponding to the deteriorated photoreceptor drum and the developing apparatus that discharges the toner differ in execution of the photoreceptor refresh control (when the determination at Step SA3 is YES), the controller 100 transfers the toner, which is discharged from the developing apparatus and adheres to the circumference surface of the photoreceptor drum corresponding to the developing apparatus, to the intermediate transfer belt 7 with the primary transfer roller (Step SA4). Then, the controller 100 moves the toner from the intermediate transfer belt 7 to the circumference surface of the deteriorated photoreceptor drum (Step SA5). Using the polishing-agent contained in the toner, the controller 100 causes the rubbing roller 41, which is located corresponding to the deteriorated photoreceptor drum, polishes the circumference surface of the deteriorated photoreceptor drum (Step SA6).

With this configuration, even if the developing apparatus located corresponding to the deteriorated photoreceptor drum and the developing apparatus that causes the toner to be discharged differ, the toner can be reliably supplied to the deteriorated photoreceptor drum via the intermediate transfer belt 7.

Second Embodiment

Figure 5A:
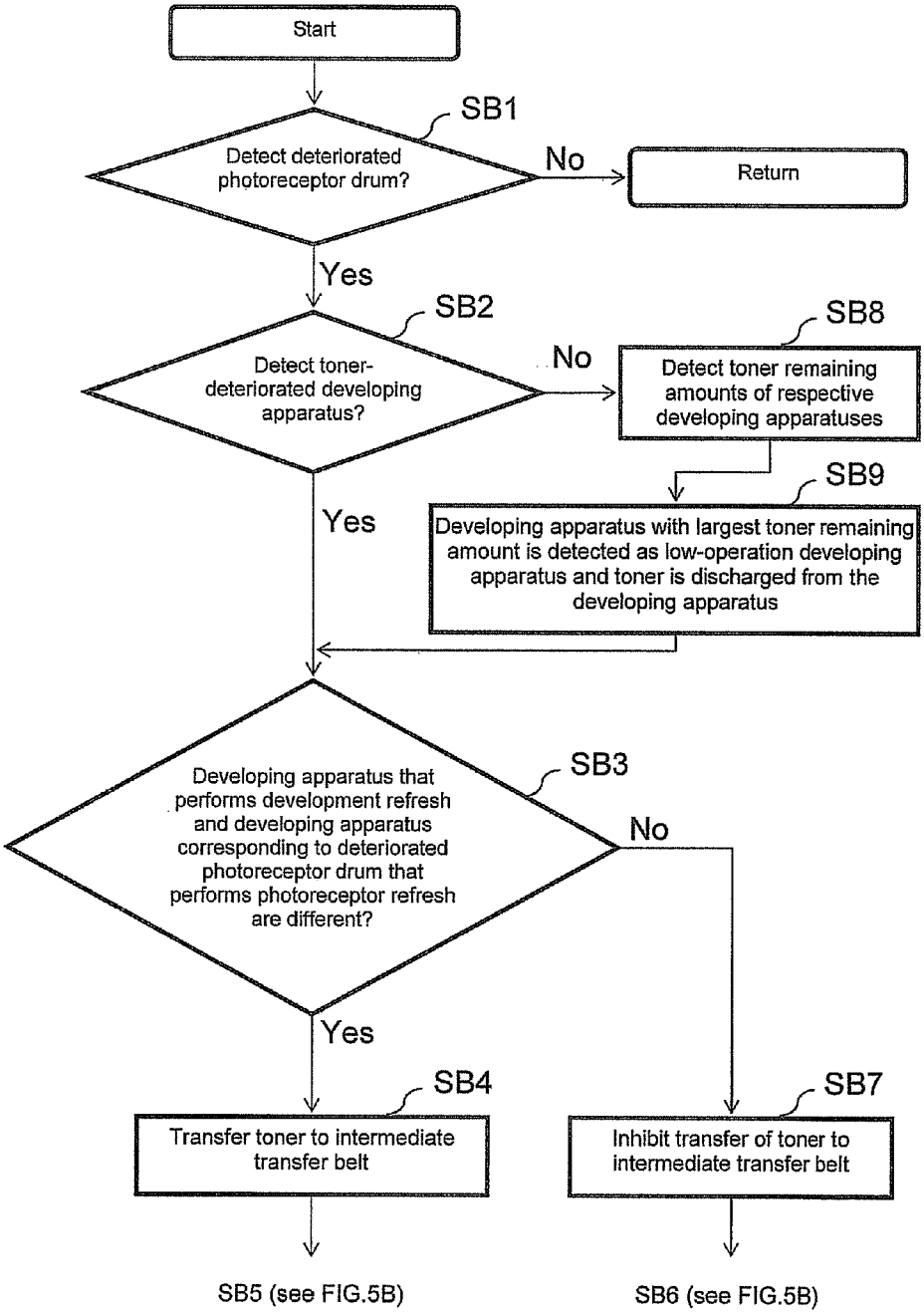
FIGS. 5A and 5B illustrate a procedure of a photoreceptor refresh control by a controller according to a second embodiment.
Figure 5B:
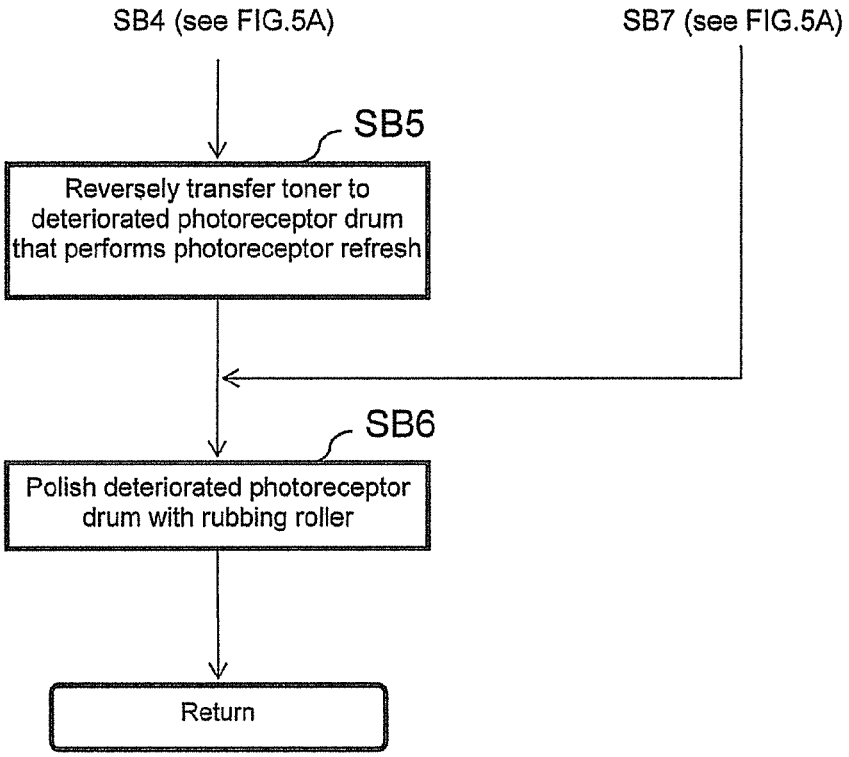

FIGS. 5A and 5B illustrate the second embodiment. The second embodiment differs from the above-described embodiment in content of the photoreceptor refresh control by the controller 100. The configuration of the hardware is similar to the above-described embodiment, and therefore the description will not be further elaborated here.

With reference to FIGS. 5A and 5B, the following specifically describes the photoreceptor refresh control according to the second embodiment.

The processes of Steps SB1 to SB7 (not illustrated) are similar to the processes of Steps SA1 to SA7, and therefore the description will not be further elaborated here.

Step B8, to which the process proceeds when the determination of Step SB2 is NO, calculates (detects) the toner remaining amounts in the respective developing apparatuses 30*a* to 30*d* based on detection signals from the toner remaining amount detecting sensor 63.

Step SB9 detects the developing apparatus with the largest toner remaining amount as the low-operation developing apparatus based on the calculation result in Step SB8. The toner is discharged from the low-operation developing apparatus, and the process proceeds to Step SB3 after the elapse of certain time.

Thus, with the second embodiment, when the controller 100 does not detect the toner-deteriorated developing apparatus (when the determination at Step SB2 is NO), the controller 100 detects the developing apparatus with the smallest toner remaining amount as the low-operation developing apparatus, and causes the toner to be discharged from the low-operation developing apparatus (Step SB9). Then, using the polishing-agent contained in the toner, the controller 100 causes the rubbing roller 41 located corresponding to the deteriorated photoreceptor drum to polish the circumference surface of the deteriorated photoreceptor drum (Step SB6).

With this configuration, the actions and effects similar to the first embodiment can be obtained. Since the toner remaining amount detecting sensor 63 is used, similarly to the first embodiment, this eliminates the need for calculating the average printing rates to detect the low-operation developing apparatus. Accordingly, an operation load taken for the controller 100 can be reduced more than the first embodiment.

Other Embodiments

The above-described respective embodiments may have the following configuration. That is, when the toner amount required for refreshing the deteriorated photoreceptor drum is more than the toner amount discharged from the toner-deteriorated developing apparatus by execution of the development refresh control, after the toner in the toner-deteriorated developing apparatus is all discharged, it is only necessary to discharge insufficient toner from another developing apparatus. The other developing apparatus is preferred to be a developing apparatus located at an image forming unit with the smallest average printing rate or a developing apparatus with the largest toner remaining amount. This preferentially uses the deteriorated toner and ensures reducing the toner consumption used in high frequency while reducing the wasteful consumption of excellent toner. Furthermore, a frequency of exchanging toner can be reduced.

In the above-described respective embodiments, to detect the deteriorated photoreceptor drum (to perform the processes at Step SA1 and Step SB1), the environmental temperature and the environment humidity may be taken into consideration. The user may input the deteriorated photoreceptor drum specified based on test printing or similar printing from the operation unit 62. In this case, the operation unit 62 and the controller 100 constitute a photoreceptor refresh unit.

In the above-described respective embodiments, instead of the processes at Step SA2 and Step SB2, the user may input the toner-deteriorated developing apparatus specified based on test printing or similar printing from the operation unit 62. In this case, the operation unit 62 and the controller 100 constitute a development refresh unit.

In the above-described respective embodiments, an electrophotographic system printer is described as the exemplary image forming apparatus 1; however, the image forming apparatus 1 according to the disclosure should not be constructed in a limiting sense. For example, the image forming apparatus 1 may be another image forming apparatus such as a copier, a scanner device, or a multi-functional peripheral.

As described above, the disclosure is effective to image forming apparatuses, particularly effective to image forming apparatuses of tandem engine with a plurality of photoreceptor drums.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus, comprising:

a plurality of photoreceptor drums each having a circumferential surface for a formation of an electrostatic latent image;

a plurality of developing devices respectively provided for each of the plurality of photoreceptor drums, the plurality of developing devices being configured to cause toner containing polishing-agent to adhere to the circumferential surfaces of the photoreceptor drums to form toner images corresponding to the electrostatic latent images;

a plurality of polishing members respectively provided for each of the plurality of photoreceptor drums, the plurality of polishing members being configured to polish the circumferential surfaces of the photoreceptor drums using the polishing-agent contained in the toner;

an endless intermediate transfer component onto which the toner images on the circumferential surfaces of the photoreceptor drums are transferred;

a primary transfer unit configured to transfer the toner images on the circumferential surfaces of the photoreceptor drums onto the intermediate transfer component;

a secondary transfer unit configured to transfer onto a recording medium the toner images transferred onto the intermediate transfer component;

a development refresh unit configured to detect, among the plurality of developing devices, a toner-deteriorated developing device in which deteriorated toner exceeds a predetermined proportion, and being configured to perform a development-refresh control process whereby toner from the detected toner-deteriorated developing device is discharged and the discharged toner is passed onto the circumferential surface of the photoreceptor drum corresponding to the toner-deteriorated developing device;

a photoreceptor refresh unit configured to detect, among the plurality of photoreceptor drums, a deteriorated photoreceptor drum requiring polishing by the polishing member, and being configured to perform a photoreceptor-refresh control process whereby the circumferential surface of the detected deteriorated photoreceptor drum is polished by the polishing member provided for the deteriorated photoreceptor drum; and a developing device detecting unit configured to detect a value related to toner consumption rate of each of the plurality of developing devices, and being configured to detect a developing device with the smallest toner consumption rate as an under-performing developing device, based on the detected value, wherein the development refresh unit is configured to detect the developing device provided for an image forming unit whose average printing rate is equal to or less than a predetermined rate, as the toner-deteriorated developing device in which the deteriorated toner exceeds a predetermined rate;

wherein the photoreceptor refresh unit is configured such that, if the development refresh unit does not detect a toner-deteriorated developing device:

the under-performing developing device detected by the developing device detecting unit is caused to discharge toner, and the circumferential surface of the deteriorated photoreceptor drum is polished using the polishing-agent contained in the toner, by the polishing member provided for the deteriorated photoreceptor drum;

wherein the photoreceptor refresh unit is configured such that, in executing the photoreceptor refresh control process, and the photoreceptor refresh unit determines whether the toner-deteriorated developing apparatus that performs the development refresh and the developing apparatus corresponding to the deteriorated photoreceptor drum are different or not, if the developing device provided for a deteriorated photoreceptor drum differs from the developing device from which toner is discharged:

the primary transfer unit is caused to transfer onto the intermediate transfer component toner discharged from the developing device and adhering to the circumferential surface of the photoreceptor drum corresponding to the developing device;

subsequently the toner is passed from the intermediate transfer component onto the circumferential surface of the deteriorated photoreceptor drum, and subsequently the circumferential surface of the deteriorated photoreceptor drum is polished using the polishing-agent contained in the toner, by the polishing member provided for the deteriorated photoreceptor drum, and wherein the plurality of polishing members are rubbing rollers mounted to cleaning units.

2. An image forming apparatus, comprising:

a plurality of photoreceptor drums each having a circumferential surface for a formation of an electrostatic latent image;

a plurality of developing devices respectively provided for each of the plurality of photoreceptor drums, the plurality of developing devices being configured to cause toner containing polishing-agent to adhere to the circumferential surfaces of the photoreceptor drums to form toner images corresponding to the electrostatic latent images;

a plurality of polishing members respectively provided for each of the plurality of photoreceptor drums, the plurality of polishing members being configured to polish the circumferential surfaces of the photoreceptor drums using the polishing-agent contained in the toner;

an endless intermediate transfer component onto which the toner images on the circumferential surfaces of the photoreceptor drums are transferred;

a primary transfer unit configured to transfer the toner images on the circumferential surfaces of the photoreceptor drums onto the intermediate transfer component;

a secondary transfer unit configured to transfer onto a recording medium the toner images transferred onto the intermediate transfer component;

a development refresh unit configured to detect, among the plurality of developing devices, a toner-deteriorated developing device in which deteriorated toner exceeds a predetermined proportion, and being configured to perform a development-refresh control process whereby toner from the detected toner-deteriorated developing device is discharged and the discharged toner is passed onto the circumferential surface of the photoreceptor drum corresponding to the toner-deteriorated developing device;

a photoreceptor refresh unit configured to detect, among the plurality of photoreceptor drums, a deteriorated photoreceptor drum requiring polishing by the polishing member, and being configured to perform a photoreceptor-refresh control process whereby the circumferential surface of the detected deteriorated photoreceptor drum is polished by the polishing member provided for the deteriorated photoreceptor drum;

a toner remaining amount detecting unit configured to detect remaining amount of toner in each of the developing devices; and a developing device detecting unit configured to detect a developing device with the largest toner remaining amount detected by the toner remaining amount detecting unit as an under-performing developing device, wherein the development refresh unit is configured to detect the developing device provided for an image forming unit whose average printing rate is equal to or less than a predetermined rate, as the toner-deteriorated developing device in which the deteriorated toner exceeds a predetermined rate;

wherein the photoreceptor refresh unit is configured to, if the development refresh unit does not detect a toner-deteriorated developing device, cause the under-performing developing device detected by the developing device detecting unit to discharge toner; and using the polishing-agent contained in the toner, polish the circumferential surface of the deteriorated photoreceptor drum, with the polishing member provided for the deteriorated photoreceptor drum;

wherein the photoreceptor refresh unit is configured such that, in executing the photoreceptor refresh control process, the photoreceptor refresh unit determines whether the toner-deteriorated developing apparatus that performs the development refresh and the developing apparatus corresponding to the deteriorated photoreceptor drum are different or not, if the developing device provided for a deteriorated photoreceptor drum differs from the developing device from which toner is discharged:

the primary transfer unit is caused to transfer onto the intermediate transfer component toner discharged from the developing device and adhering to the circumferential surface of the photoreceptor drum corresponding to the developing device;

subsequently the toner is passed from the intermediate transfer component onto the circumferential surface of the deteriorated photoreceptor drum, and subsequently the circumferential surface of the deteriorated photoreceptor drum is polished using the polishing-agent contained in the toner, by the polishing member provided for the deteriorated photoreceptor drum, and wherein the plurality of polishing members are rubbing rollers mounted to cleaning units.

* * * * *